US010553344B2

(12) United States Patent
Kim et al.

(10) Patent No.: US 10,553,344 B2
(45) Date of Patent: Feb. 4, 2020

(54) METHOD OF MANUFACTURING COIL DEVICE

(71) Applicant: WITS Co., Ltd., Yongin-si, Gyeonggi-do (KR)

(72) Inventors: Han Kim, Suwon-si (KR); Kang Heon Hur, Suwon-si (KR); Sang Jong Lee, Suwon-si (KR); Jung Wook Seo, Suwon-si (KR)

(73) Assignee: WITS Co., Ltd., Gyeonggi-do (KR)

( * ) Notice: Subject to any disclaimer, the term of this patent is extended or adjusted under 35 U.S.C. 154(b) by 55 days.

(21) Appl. No.: 15/285,605

(22) Filed: Oct. 5, 2016

(65) Prior Publication Data

US 2017/0271071 A1 Sep. 21, 2017

(30) Foreign Application Priority Data

Mar. 21, 2016 (KR) ..... 10-2016-0033199

(51) Int. Cl.

| | |
|---|---|
| ***H01F 7/06*** | (2006.01) |
| ***H01F 27/28*** | (2006.01) |
| ***H01F 41/04*** | (2006.01) |
| ***H01F 38/14*** | (2006.01) |

(52) U.S. Cl.

CPC ..... *H01F 27/2804* (2013.01); *H01F 38/14* (2013.01); *H01F 41/041* (2013.01); *H01F 2027/2809* (2013.01)

(58) Field of Classification Search

CPC ..... H01F 41/041; H01F 27/2804

See application file for complete search history.

(56) References Cited

U.S. PATENT DOCUMENTS 2,911,605 A * 11/1959 Wales, Jr. ..... H01F 17/0006 29/604
4,495,546 A * 1/1985 Nakamura ..... H01L 23/5387 257/E23.177
6,039,600 A * 3/2000 Etters ..... H01R 12/592 439/493
6,077,124 A * 6/2000 Etters ..... H01R 12/592 439/496

(Continued)

FOREIGN PATENT DOCUMENTS

CN 101291562 A 10/2008
CN 103747727 A 4/2014

(Continued)

OTHER PUBLICATIONS

Chinese Office Action dated Jun. 28, 2018 in corresponding Chinese Patent Application No. 201611100176.X (13 pages in English and 8 pages in Chinese).

(Continued)

*Primary Examiner* — Paul D Kim

(74) *Attorney, Agent, or Firm* — Harness, Dickey & Pierce, P.L.C.

(57) ABSTRACT

A method of manufacturing a coil device and the coil device includes a base layer and a coil pattern formed on a surface of the base layer. The method of manufacturing a coil device includes forming a seed layer of a coil by bonding a copper foil to a base layer, etching to remove a portion of the copper foil, and plating a plating layer on the seed layer.

10 Claims, 7 Drawing Sheets

(56) References Cited

U.S. PATENT DOCUMENTS

| | | | | |
|---|---|---|---|---|
| 6,239,967 | B1 * | 5/2001 | Juan | G06K 19/07749 336/192 |
| 6,358,064 | B2 * | 3/2002 | Szalay | H01R 12/62 439/493 |
| 6,412,702 | B1 * | 7/2002 | Ishikawa | G06K 19/072 235/380 |
| 6,469,371 | B2 * | 10/2002 | Akagawa | G06K 19/07749 174/260 |
| 6,889,433 | B1 * | 5/2005 | Enomoto | H05K 3/4069 29/825 |
| 7,439,962 | B2 * | 10/2008 | Reynolds | G06F 3/03547 345/173 |
| 2008/0259523 | A1 | 10/2008 | Lim et al. | |
| 2013/0175984 | A1 | 7/2013 | Yamazaki et al. | |
| 2014/0176138 | A1 | 6/2014 | Imamura et al. | |
| 2015/0255206 | A1 | 9/2015 | Han et al. | |
| 2015/0340139 | A1 | 11/2015 | Arndt | |

FOREIGN PATENT DOCUMENTS

| | | | |
|---|---|---|---|
| CN | 104685585 | A | 6/2015 |
| JP | 2013-140880 | A | 7/2013 |
| KR | 10-0690106 | B1 | 3/2007 |
| KR | 10-2011-0015991 | A | 2/2011 |
| KR | 10-2014-0053644 | A | 10/2012 |
| KR | 10-2015-0080737 | A | 7/2015 |
| KR | 10-2015-0105088 | A | 9/2015 |

OTHER PUBLICATIONS

Korean Office Action dated Jul. 17, 2017 in corresponding Korean Patent Application No. 10-2016-0033199 (14 pages with English translation).

Korean Office Action dated Jan. 29, 2018 in corresponding Korean patent application No. 10-2016-0033199 (7 pages in English and 6 pages in Korean).

* cited by examiner

METHOD OF MANUFACTURING COIL DEVICE

CROSS-REFERENCE TO RELATED APPLICATION

This application claims the benefit under 35 U.S.C. § 119(a) of Korean Patent Application No. 10-2016-0033199 filed on Mar. 21, 2016, with the Korean Intellectual Property Office, the entire disclosure of which is incorporated herein by reference for all purposes.

BACKGROUND

1. Field

The present disclosure relates to a method of manufacturing a coil device and a coil device.

2. Description of Related Art

Wireless power transfer technology for transferring power wirelessly and receiving the wirelessly transferred power through a coil has been applied to the battery chargers of various devices, such as, smartphones and various home appliances. While wireless power transfer technology has a wide range of applications, its availability and use may increase in the future because of its applications to domains, such as the charging of electric vehicles. In the field of the wireless power transfer technology, there have been various attempts to improve a coil device used in transferring and/or receiving power in order to enhance charging efficiency, extend the lifespan of the device, and increase the performance of a circuit.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

In a general aspect, there is provided a method of manufacturing a coil device, including forming a seed layer of a coil by bonding a copper foil to a base layer, etching the seed layer to remove a portion of the copper foil, and plating a plating layer on the seed layer.

The forming of the seed layer may include coating a dry film on the copper foil of the seed layer, removing a portion of the dry film through exposure and developing, etching to remove a portion of the copper foil from which the dry film is removed, and stripping the remaining dry film.

The seed layer may be formed to allow both ends of the seed layer to be connected to each other, and the plating of the plating layer comprises applying a voltage through the connected ends of the seed layer.

The method may include separating both ends of the coil.

The coil may include a first coil and a second coil, which form the seed layer such that a first end of a seed layer of the first coil may be connected to a first end of a seed layer of the second coil, and a second end of the seed layer of the first coil may be connected to a second end of the seed layer of the second coil, and the plating of the plating layer may include applying a voltage through the first end of the seed layer of the first coil and the second end of the seed layer of the first coil.

The method may include separating the first end of the first coil from the first end of the second coil, and separating the second end of the first coil from the second end of the second coil.

The seed layer may include only the copper foil, and the plating layer is formed only through the plating process.

The removing of the portion of the dry film through the exposure and the developing may include changing a portion of the dry film exposed to light into a photocured polymer and leaving a portion of the dry film not exposed to light as an uncured monomer, in response to exposing the dry film to the light, and removing the uncured monomer portion of the dry film, in response to immersing the seed layer in a developing solution.

The base layer may be formed of a material having relatively low conductivity and the seed layer is formed of a material having relatively high conductivity.

The copper foil may be bonded to the base layer through a hot press process.

In another general aspect, there is provided a coil device, including a base layer, and a first coil pattern formed on a surface of the base layer, wherein the first coil pattern comprises a first seed layer formed using a copper foil bonded to a surface of the base layer, and a first plating layer formed on the first seed layer through plating.

The first seed layer may include only the copper foil, and the first plating layer is formed only through the plating process.

The first seed layer may be formed such that a portion of the copper foil is removed through etching.

A width of the first coil pattern may be greatest on a surface on which the coil pattern is bonded to the base layer.

The coil device may include a second coil pattern formed on another surface of the base layer and connected to the first coil pattern, the second coil pattern may include a second seed layer formed using the copper foil bonded to the another surface of the base layer, and a second plating layer formed on the second seed layer through plating.

The second seed layer may include only the copper foil, and the second plating layer may be formed only through the plating process.

In a general aspect, there is provided a method of manufacturing a coil device, including forming a first seed layer and a second seed layer of a coil by bonding a copper foil to opposing surfaces of a base layer, etching to remove a portion of the copper foil, and plating a first plating layer and a second plating layer on the first seed layer and the second seed layer, respectively.

The forming of the first seed layer and the second seed layer may include coating a dry film on the copper foil of the first seed layer and the second seed layer, changing a portion of the dry film exposed to light into a photocured polymer and leaving a portion of the dry film not exposed to light as an uncured monomer, in response to covering a portion of the dry film coated on the first seed layer and the second seed layer with a masking portion, and removing the uncured monomer portion of the dry film on the first seed layer and the second seed layer, in response to immersing the first seed layer and the second seed layer in a developing solution etching to remove a portion of the copper foil from which the dry film is removed, and stripping to remove the remaining dry film from the first seed layer and the second seed layer.

The method may include forming a via on the base layer to connect the first seed layer and the first plating layer and the second seed layer and the second plating layer formed on opposing surfaces of the base layer.

Other features and aspects will be apparent from the following detailed description, the drawings, and the claims.

Figure 1:
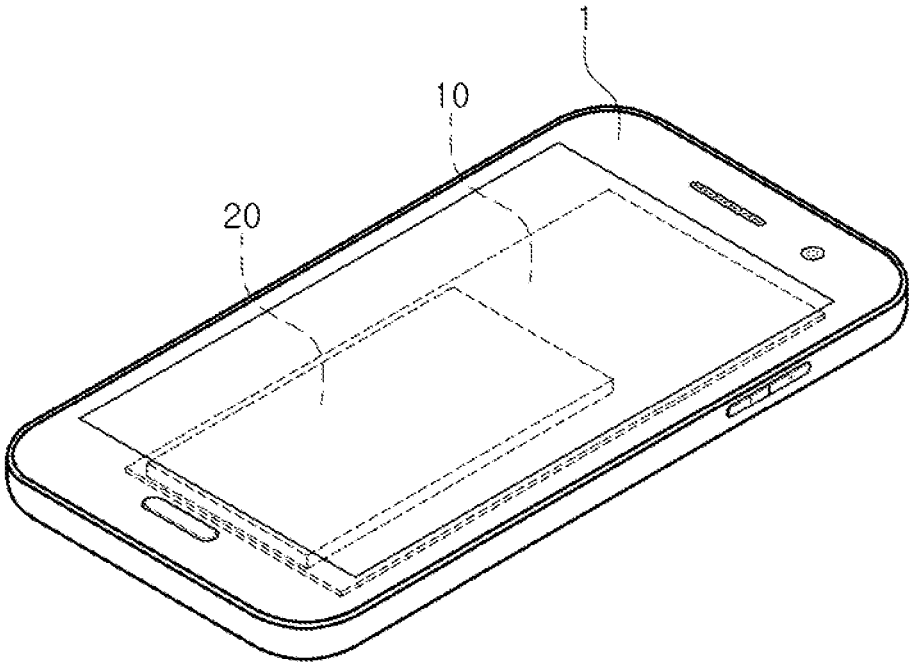
FIG. 1 is a diagram illustrating an example of a device including a coil device.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or apparatuses described herein. However, various changes, modifications, and equivalents of the methods, apparatuses, and/or apparatuses described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or apparatuses described herein that will be apparent after an understanding of the disclosure of this application.

FIG. 1 is a diagram illustrating an example of a device including a coil device. A device 1 according to an embodiment includes a coil device 10 and a power supply unit 20.

In an example, the coil device 10 receives power, which is transferred wirelessly. In an example, the coil device 10 includes a plurality of coils, and at least one of the plurality of coils may receive the wirelessly transferred power.

The power supply unit 20 stores energy using power received by the coil device 10, and supplies power for each portion of the device 1. In an example, the power supply unit 20 includes a battery.

Device 1 performs various operations using energy stored in the power supply unit 20. In an example, the device 1 displays a variety of information on a display device (not illustrated) using power received from the power supply unit 20. In another example, the device 1 performs mobile communications through a communications module (not illustrated), a microphone (not illustrated), and a speaker (not illustrated), using power received from the power supply unit 20.

FIG. 1 illustrates an example where the device 1 includes a separate coil device 10. In other examples, the coil device 10 may be formed integrally with the device 1, without departing from the spirit and scope of the illustrative examples described. For example, a receiving coil of the coil device 10 may be formed to be integrated with a case of the device 1. In this example, the case of the device 1 may be provided as the coil device.

In the example shown in FIG. 1, the coil device 10 and the power supply unit 20 are configured as separate components. However, in other examples, the coil device 10 and the power supply unit 20 may be configured as a single component in which the coil device 10, the battery of the power supply unit 20 are combined. In this case, the receiving coil of the coil device 10 may be integrated with a case of the battery. In this example, the case of the battery of the power supply unit 20 may be provided as the coil device.

FIG. 1 illustrates an example where a mobile phone is shown as the device including the coil device 10. However, the coil device 10 may be applied to various devices receiving power wirelessly. For example, the coil device 10 may be embedded in or interoperate with various devices such as, for example, a smart phone, a wearable smart device (such as, for example, a ring, a watch, a pair of glasses, glasses-type device, a bracelet, an ankle bracket, a belt, a necklace, an earring, a headband, a helmet, a device embedded in the cloths), a personal computer (PC), a laptop, a notebook, a subnotebook, a netbook, or an ultra-mobile PC (UMPC), a tablet personal computer (tablet), a phablet, a mobile internet device (MID), a personal digital assistant (PDA), an enterprise digital assistant (EDA), a digital camera, a digital video camera, a portable game console, an MP3 player, a portable/personal multimedia player (PMP), a handheld e-book, an ultra mobile personal computer (UMPC), a portable lab-top PC, a global positioning system (GPS) navigation, a personal navigation device or portable navigation device (PND), a handheld game console, an e-book, and devices such as a high definition television (HDTV), an optical disc player, a DVD player, a Blue-ray player, a setup box, robot cleaners, a home appliance, content players, communication systems, image processing systems, graphics processing systems, other consumer electronics/information technology (CE/IT) device, or any other device capable of wireless communication or network communication consistent with that disclosed herein. The coil device 10 may be embedded in or interoperate with a smart appliance, an intelligent vehicle, an electric vehicle, a hybrid vehicle, a smart home environment, or a smart building environment.

Figure 2:
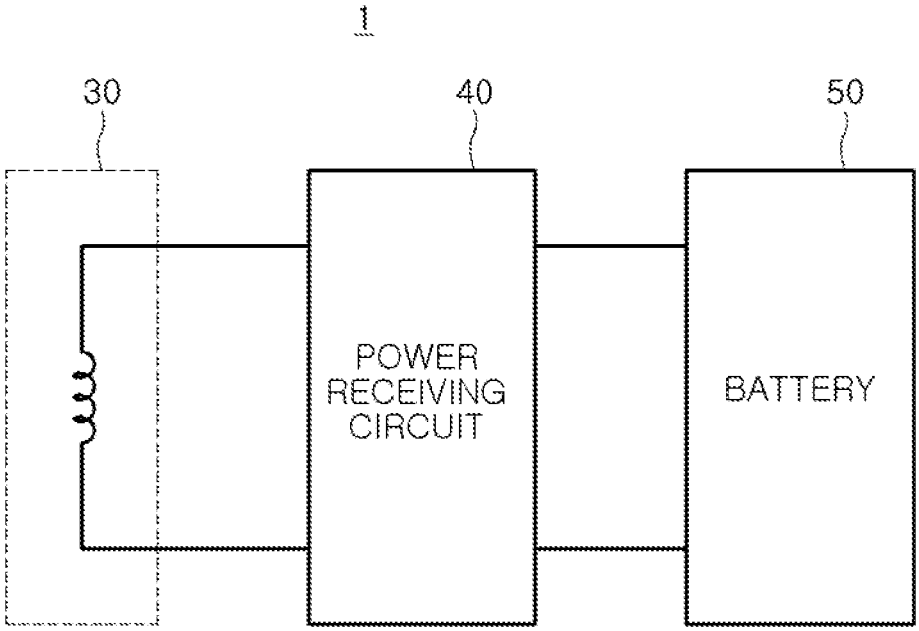
FIG. 2 is a diagram illustrating an example of a device including a coil device.

FIG. 2 is a diagram illustrating an example of a device including a coil device. In an example, a device 1 including a coil device includes a power receiving coil 30, a power receiving circuit 40, and a battery 50.

The power receiving coil 30 receives power, which is wirelessly transferred. In an example, when a magnetic field around the power receiving coil 30 is changed by a wireless power transfer device, induced electromotive force is generated at both ends of the power receiving coil 30. Using a principle described above, power may be wirelessly transferred to the device 1, which includes the coil device, from the wireless power transfer device. The power receiving coil 30 may be formed using various methods, such as, for example, the power receiving coil 30 may be formed to be included in the coil device of the device 1 (see 10 in FIG. 1), the power receiving coil 30 may be formed to be integrated with a case of the device 1, may be formed to be integrated with a case of the battery 50.

The power receiving circuit 40 rectifies voltages at both ends of the power receiving coil 30, thus providing charging power. The power receiving circuit 40 may include various circuits, such as, for example, a rectifier circuit, a smoothing circuit, and an amplifier circuit. In an example, the power receiving circuit 40 is included in the coil device (see 10 in FIG. 1) of the device 1. In another example, the power receiving circuit 40 is included in the power supply unit (see 20 in FIG. 1). In another example, the power receiving circuit 40 is formed in a different printed circuit board included in the device 1 (not shown). In an example, the power receiving circuit 40 sends various types of signals to the power receiving coil 30 so that various types of communications signals may be transmitted to the wireless power transfer device through the power receiving coil 30.

The battery 50 stores energy by inputting charging power provided by the power receiving circuit 40. The battery 50 also supplies power to various components in the device, such as the power receiving circuit 40. In an example, the battery 50 is included in the power supply unit 20 of the device 1.

In the non-exhaustive examples illustrated in FIGS. 1 and 2, the coil device is provided as a wireless power receiving device, which receives wirelessly transferred power, but the coil device may be provided in other forms, without departing from the spirit and scope of the illustrative examples described. For example, the coil device may be provided as the wireless power transfer device, which transfers power wirelessly.

Hereinafter, by way of a non-exhaustive example, the case in which the coil device is provided as the wireless power receiving device, which receives wirelessly transferred power will be described.

Figure 3:
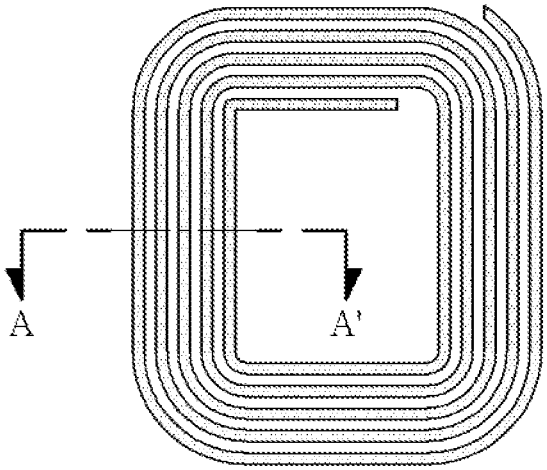
FIG. 3 is a diagram illustrating an example of a coil of a coil device.
Figure 4:
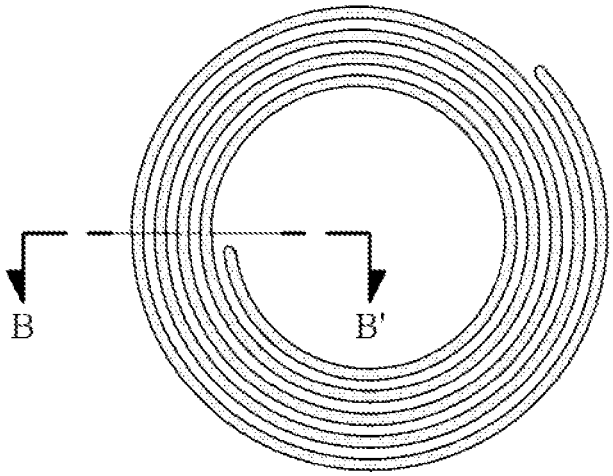
FIG. 4 is a diagram illustrating an example of a coil of a coil device.

FIGS. 3 and 4 are diagrams illustrating examples of a coil of a coil device.

As illustrated in FIG. 3, the coil of the coil device according to an embodiment may be provided as a rectangular spiral coil. As illustrated in FIG. 4, the coil of the coil device according to another embodiment may be provided as a circular spiral coil. Furthermore, the coil of the coil device according to an embodiment may be provided as a spiral coil having various shapes not illustrated in FIGS. 3 and 4, without departing from the spirit and scope of the illustrative examples described.

Figure 5:
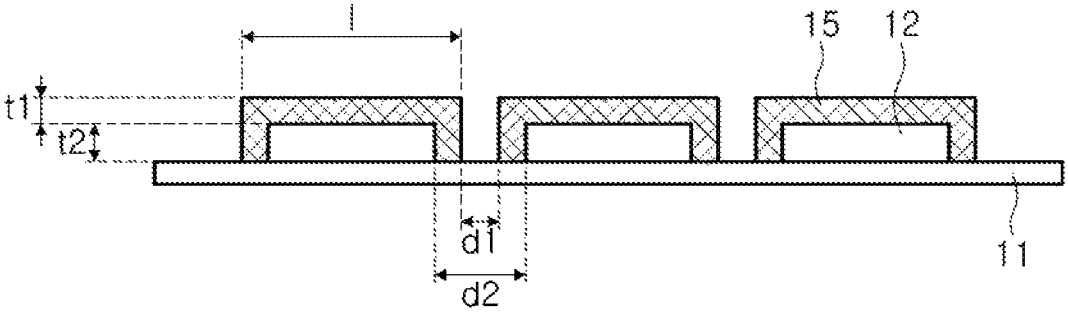
FIG. 5 is a diagram illustrating an example of a coil of a coil device.

FIG. 5 is a diagram illustrating an example of a coil of a coil device, taken along line A-A' of FIG. 3.

As illustrated in FIG. 5, the coil device according to an embodiment includes a base layer 11, a seed layer 12, and a plating layer 15. A coil pattern of the coil device according to an embodiment includes the seed layer 12 and the plating layer 15. In an example, the base layer 11 is formed using a material having relatively low conductivity. For example, the base layer 11 may be formed using a prepreg (PPG). In an example, the seed layer 12 may is formed using a material having relatively high conductivity. For example, the seed layer 12 is formed such that a copper foil is bonded to the base layer 11, and an etching process is performed. In an example, the copper foil is bonded to the base layer 11 through a hot press process. In an example, the copper foil is manufactured such that it is rolled to have a required thickness. The plating layer 15 may be formed using a material having relatively high conductivity. As shown in FIG. 5, in an example, the plating layer 15 is formed by being grown from the seed layer 12 on surfaces of the seed layer 12 that are not bonded to the base layer 11 through an electroplating method.

In an example, a thickness t1 of the plating layer 15 is determined based on the number of times that a plating process is performed. In an example, the thickness t1 of the plating layer 15 is determined by a thickness of the plating layer 15 grown by performing the plating process once or twice. Depending on the number of times that the plating process is performed, the thickness t1 of the plating layer 15 may be in the range of 20 μm to 40 μm.

A thickness t2 of the seed layer 12 is determined by a value obtained by subtracting the thickness t1 of the plating layer 15 from the overall thickness of the coil. In addition, a distance d1 between coils may be additionally considered in a final product.

As described above, the seed layer 12 may be formed through the etching process. When the seed layer 12 is formed through the etching process, a distance d2 between patterns of the seed layer 12 is at least more than twice a thickness t2 of the pattern, as the etching process is performed at the same speed in various directions.

In an example, when a thickness of the coil is around 70 μm to 80 μm, the seed layer 12 is manufactured to have the thickness of around 45 μm. The seed layer 12 may be formed through the hot press process and the etching process. Therefore, the distance d2 between the patterns of the seed layer 12 may be around 90 μm.

The plating layer 15 is formed to have the thickness of around 25 μm on the seed layer 12 through the plating process. The plating layer 15 may be grown to have substantially equal thicknesses on all surfaces of the seed layer 12, except the surface of the seed layer 12 bonded to the base layer 11. Therefore, an overall thickness of t1 and t2, (t1+t2), of the coil pattern of the coil device is around 70 μm, and a distance d1 between the patterns may be around 40 μm, i.e., d2−2*t1 (90 μm−2*25 μm).

According to requirement, the plating process may be additionally performed so that the thickness of the plating layer 15 is increased by 5 μm to 10 μm. In this case, the total thickness of t1 and t2 of the coil pattern of the coil device may be around 75 μm to 80 μm, and the distance d1 of the patterns may be around 20 μm to 30 μm.

The seed layer 12 of the coil of the coil device according to an embodiment may include only the copper foil, while the plating layer 15 of the coil may be formed only through the plating process. FIG. 5 illustrates that a width of a surface of the coil, bonded to the base layer 11, is equal to that of the opposite surface thereof. However, in other examples, the width of the surface of the coil, bonded to the base layer 11, may be greater than that of the opposite surface thereof.

In addition, FIG. 5 illustrates that a cross section of the coil is rectangular. In another example, the cross section of the coil may be rounded in the corners to have a shape similar to an arch. In this case, a width of the coil is the greatest on the surface bonded to the base layer 11.

A cross-sectional view taken along line B-B' of FIG. 4 may be the same as that in FIG. 5, which is not illustrated, and the above descriptions of FIG. 5, is also applicable to the cross-sectional view taken along line B-B' of FIG. 4, and are incorporated herein by reference. Thus, the above description may not be repeated here.

FIGS. 6A to 6I are diagrams illustrating examples of a method of manufacturing a coil device, and illustrating an example in which a coil is formed on a surface of a substrate.

Figure 6A:
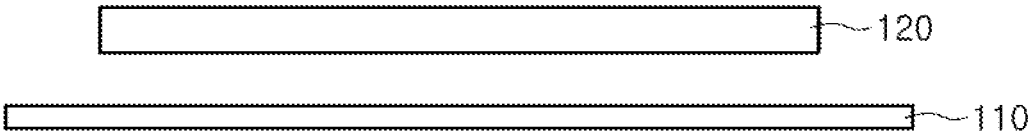
FIGS. 6A to 6I are diagrams illustrating examples of a method of manufacturing a coil device.

In FIG. 6A, a copper foil 120 and a base layer 110 are provided. The copper foil 120 may be manufactured by rolling a raw material to have a desired thickness.

Figure 6B:
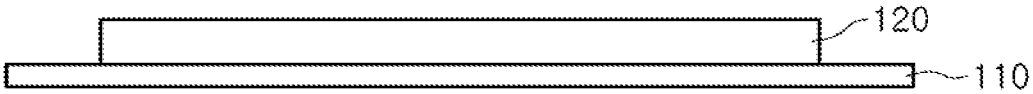

In FIG. 6B, the copper foil 120 is bonded to the base layer 110. In an example, the copper foil 120 is bonded to the base layer 110 through a hot press process.

Figure 6C:
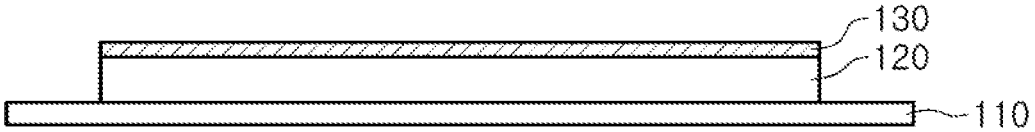

In FIG. 6C, a dry film 130 is coated on the copper foil 120. In an example, the dry film is coated on a plate (such as a copper clad laminate (CCL)) manufactured in FIG. 6B by applying a determined levels of heat and pressure. In an example, the levels of heat and pressure may be predetermined.

Figure 6D:
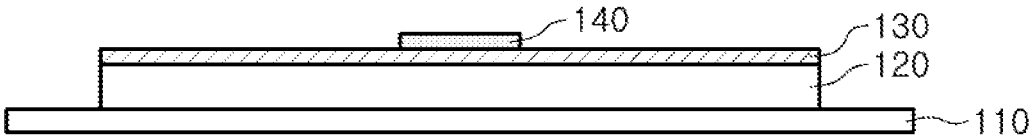

In FIG. 6D, a circuit is formed, and an exposure process is performed. When the exposure process is performed, a portion exposed to light, or a portion not included in a masking portion 140 in FIG. 6D, is changed into a photocured polymer. A portion not exposed to light, or the masking portion 140 in FIG. 6D remains an uncured monomer.

Figure 6E:
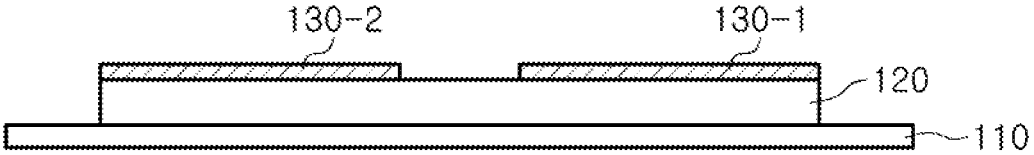

In FIG. 6E, a developing process is performed. When the plate having gone through the exposure process in FIG. 6D is immersed in a developing solution, the dry film in the portion not exposed to light is removed. The dry films 130-1 and 130-2, which have changed into the photocured polymer through the exposure process in FIG. 6D remain.

Figure 6F:
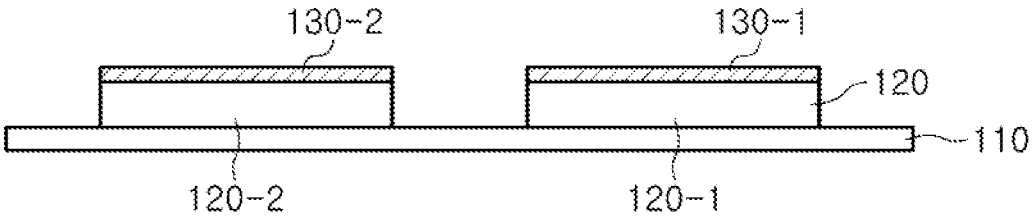

In FIG. 6F, the etching process is performed. An exposed portion of the copper foil, i.e., a portion not included in the portion covered with the dry films 130-1 and 130-2, is removed by a chemical agent. Copper foils 120-1 and 120-2, which remain after the etching process, become a seed layer.

Figure 6G:
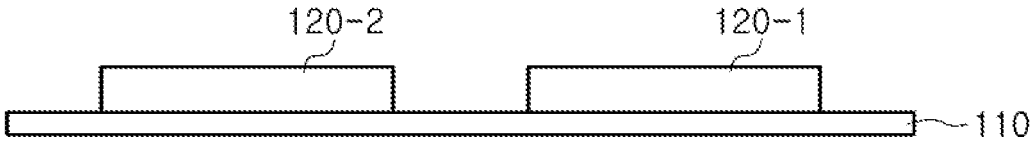

In FIG. 6G, a stripping process is performed. Remaining dry films 130-1 and 130-2 are removed using sodium hydroxide (NaOH), potassium hydroxide (KOH), or the like. Only the seed layers 120-1 and 120-2 remain after the stripping process.

Figure 6H:
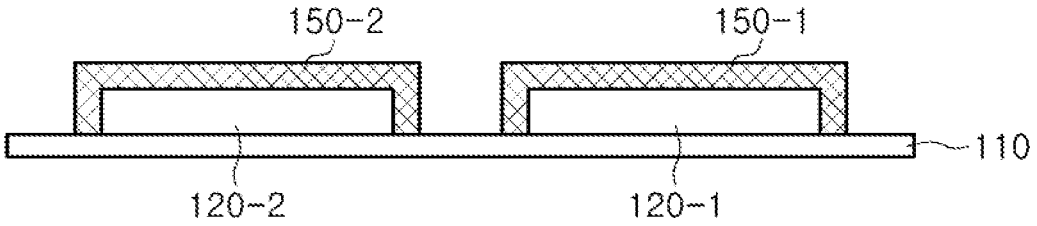

In FIG. 6H, a plating process is performed. Through the plating process, plating layers 150-1 and 150-2 are formed on the surfaces of the seed layers 120-1 and 120-2.

Figure 6I:
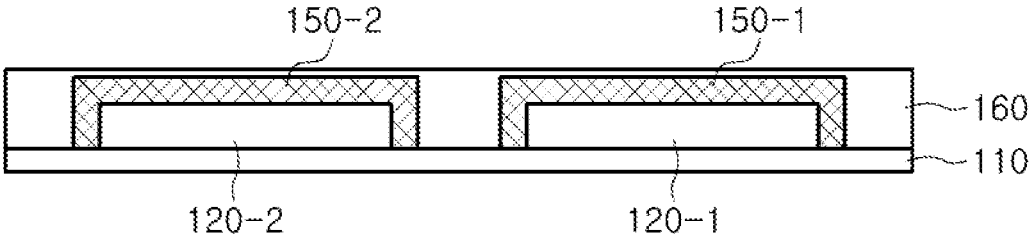

In FIG. 6I, a solder resist 160 is coated.

Figure 7:
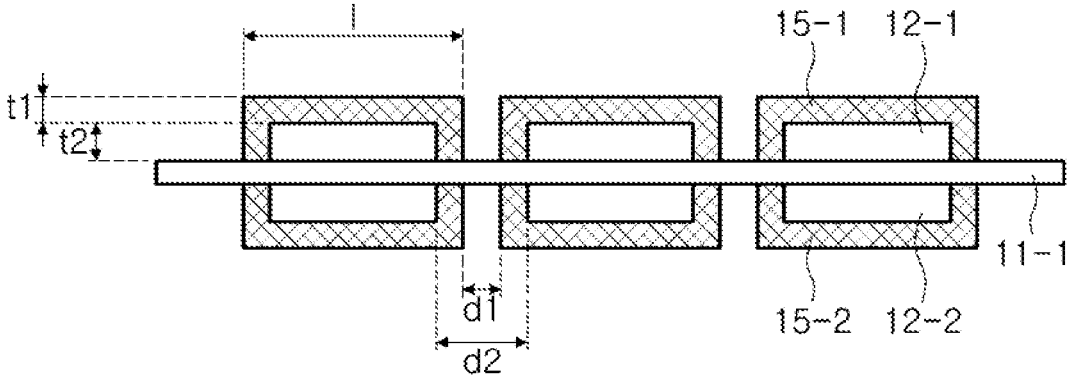
FIG. 7 is a diagrams illustrating examples of a coil device.

FIG. 7 is a diagram illustrating an example of a coil device. As illustrated in FIG. 7, the coil device includes a coil having seed layers 12-1 and 12-2 and plating layers 15-1 and 15-2 formed on respective opposing surfaces of a base layer 11-1. In an example, a coil pattern including the seed layer 12-1 and the plating layer 15-1, formed on one surface of the base layer 11-1 is electrically connected to a coil pattern including the seed layer 12-2 and the plating layer 15-2, formed on the other surface of the base layer 11-1 through a via (not illustrated) formed in the base layer 11-1.

The coil device according to an embodiment illustrated in FIG. 7 is the same as that illustrated in FIG. 5 except that the coil pattern is formed on opposing surfaces of the base layer 11-1. The above descriptions of FIG. 5, is also applicable to FIG. 7, and are incorporated herein by reference. Thus, the above description may not be repeated here.

FIGS. 8A to 8I are diagrams illustrating examples of a method of manufacturing a coil device, and illustrate a case in which a coil is formed on opposing surfaces of a substrate.

When the coil is formed on opposing surfaces of the substrate, operations of FIGS. 6A to 6I are performed on opposing surfaces of the base layer 210. Therefore, referring to a description of FIGS. 6A to 6I will facilitate understanding of operations in FIGS. 8A to 8I. The above descriptions of FIGS. 6A to 6I, are also applicable to FIGS. 8A to 8I, and are incorporated herein by reference. Thus, the above description may not be repeated here.

Figure 8A:
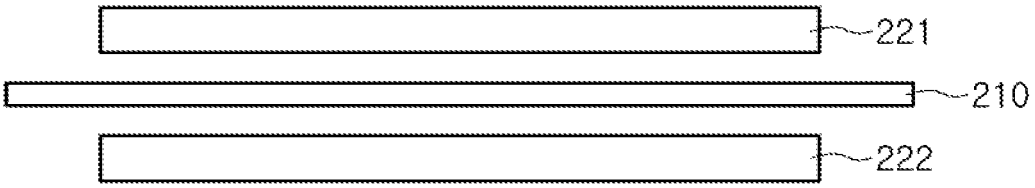
FIGS. 8A to 8I are diagrams illustrating examples of a method of manufacturing a coil device.
Figure 8B:
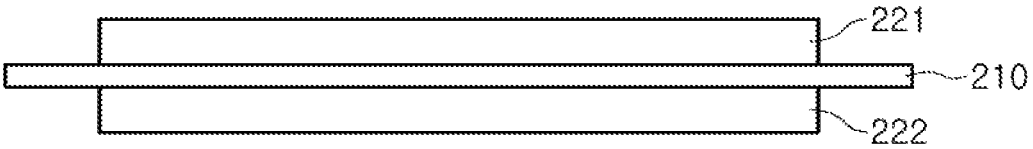
Figure 8C:
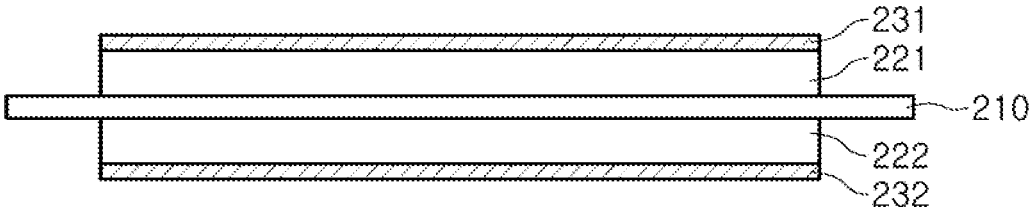
Figure 8D:
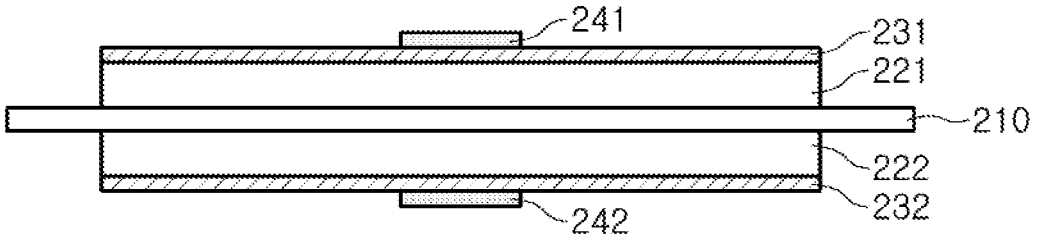
Figure 8E:
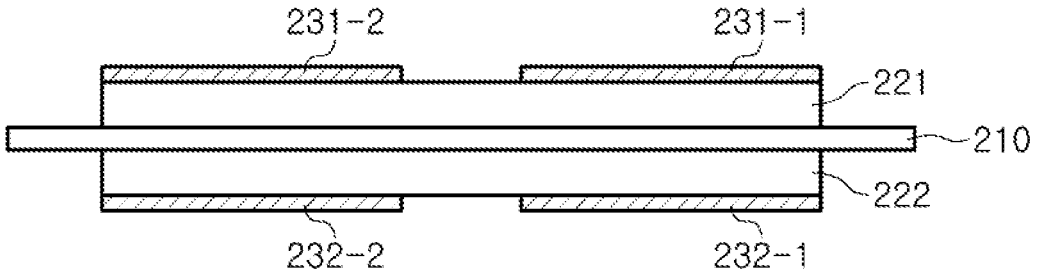
Figure 8F:
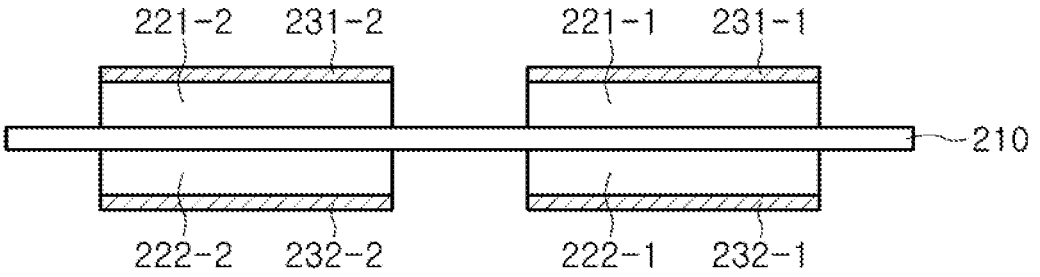
Figure 8G:
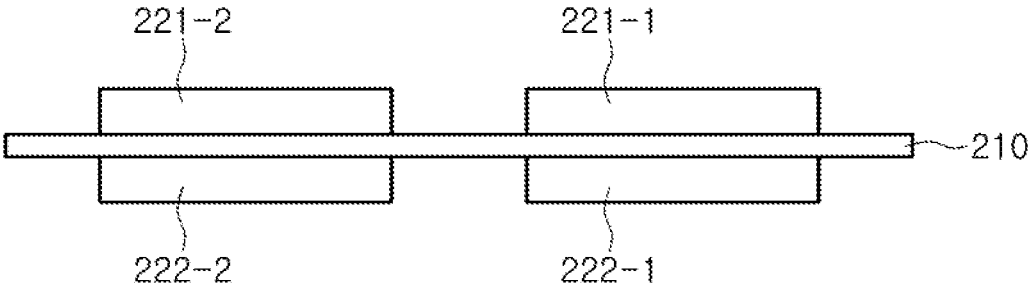
Figure 8H:
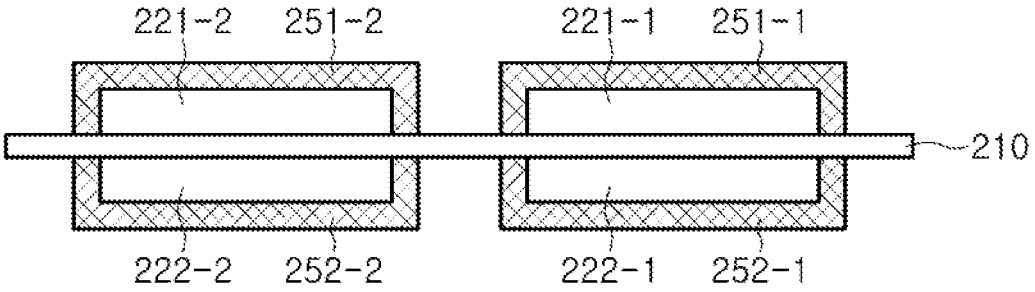
Figure 8I:
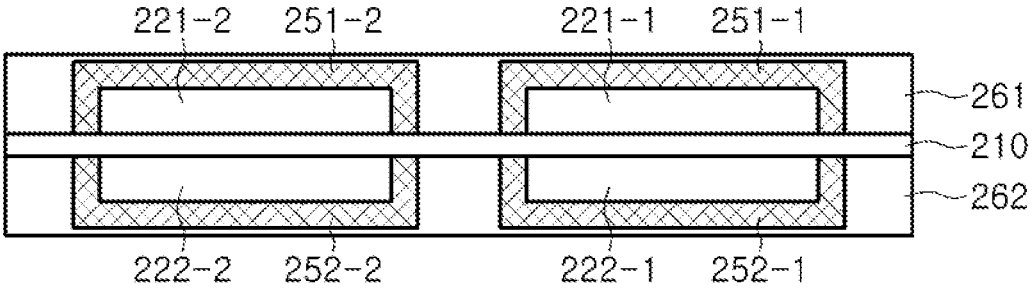

In FIG. 8A, copper foils 221 and 222 and the base layer 210 are provided. In FIG. 8B, the copper foils 221 and 222 are bonded to the base layer 210. In FIG. 8C, dry films 231 and 232 are coated on the copper foils 221 and 222, respectively. In FIG. 8D, a circuit is formed, and an exposure process is performed. In FIG. 8E, a developing process is performed, and the dry films 231-1, 231-2, 232-1, and 232-2, which changed into a photocured polymer, remain after the developing process. In FIG. 8F, an etching process is performed. In FIG. 8G, a stripping process is performed, and thus seed layers 221-1, 221-2, 222-1, and 222-2 are formed. In FIG. 8H, a plating process is performed, thus forming plating layers 251-1, 251-2, 252-1, and 252-2 on surfaces of the seed layers 221-1, 221-2, 222-1, and 222-2, respectively. In FIG. 8I, solder resists 261 and 262 are coated.

Figure 9:
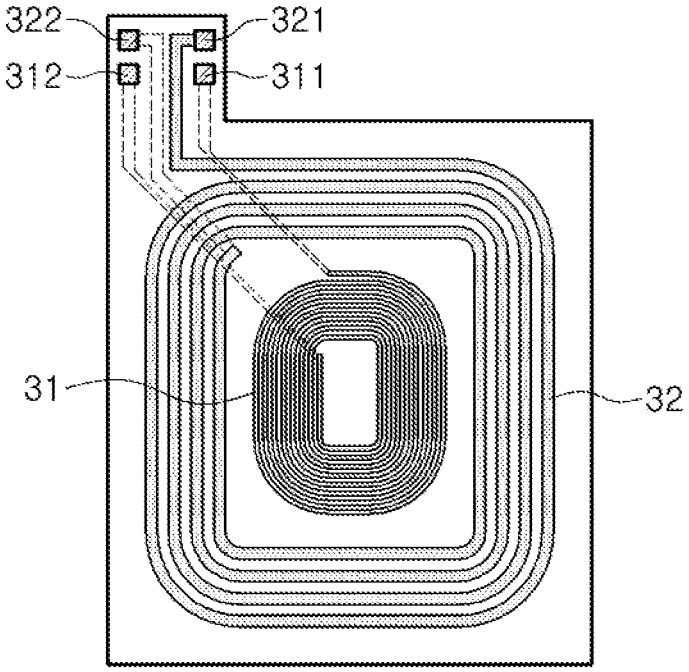
FIG. 9 is a diagram illustrating an example of a coil device.

FIG. 9 is a diagram illustrating an example of a coil device. In addition, the coil device according to an embodiment may include a first coil 31 and a second coil 32.

In an example, the first coil 31 receives wirelessly transferred power or transfers power wirelessly, while the second coil 32 transmits or receives data.

In an example, an entirety of both ends 311 and 312 of the first coil 31 and both ends 321 and 322 of the second coil 32 are disposed on a side of the coil device. In an example, both ends 311 and 312 of the first coil 31 are connected to a power receiving circuit including a rectifier, while both ends 321 and 322 of the second coil 32 are connected to a circuit modulating or demodulating data.

The first coil 31 includes the seed layer and the plating layer. According to a method of manufacturing the coil device according to an embodiment, when a plating process is performed, a predetermined voltage may be applied to both ends 311 and 312 of the first coil 31. For example, a positive voltage is applied to one end 311 of the first coil 31, while a ground voltage (or a negative voltage) may be applied to the other end 312 of the first coil.

In the same manner as the first coil 31, the second coil 32 may include the seed layer and the plating layer. In an example, in order to perform the plating process, both ends 311 and 312 of the first coil 31 may be connected to both ends 321 and 322 of the second coil 32, respectively, and may be separated from each other after the plating process is performed. In the case of each seed layer of the first coil 31 and the second coil 32, formed through exposure, developing, etching, and stripping processes (see FIGS. 6D to 6G or FIGS. 8D to 8G), both ends of the seed layer of the first coil 31 may be connected to both ends of the seed layer of the second coil 32, respectively. After the plating process (see FIG. 6H or FIG. 8H) is performed, and a plating layer is formed on each of the first coil 31 and the second coil 32, both ends of the first coil 31 may be separated from both ends of the second coil 32, respectively.

In an example, when the plating process is performed, the ground voltage (or the negative voltage) is applied to the entirety of the coil. In this case, in order to perform the plating process, both ends 311 and 312 of the first coil 31 (or both ends 311 and 312 of the first coil 31 and both ends 321 and 322 of the second coil 32) may be connected to each other, and may be separated from each other after the plating process is performed. In the case of the seed layer of the first coil 31 (or each seed layer of the first coil 31 and the second coil 32) formed through the exposure, developing, etching, and stripping processes (see FIGS. 6D to 6G or FIGS. 8D to 8G), both ends of the seed layer of the first coil 31 (or the entirety of both ends of the seed layer of the first coil 31 and both ends of the seed layer of the second coil 32) may be connected to each other. When the plating process (see FIG. 6H or FIG. 8H) is performed, a connected portion may be grounded or the negative voltage may be applied to the connected portion so that the seed layer may have a predetermined electric potential (the ground voltage or the negative voltage). After the plating process (see FIG. 6H or FIG. 8H) is performed, and the plating layer is formed in each of the first coil 31 and the second coil 32, both ends of the first coil 31 (or each of both ends of the first coil 31 and each of both ends of the second coil 32) may be separated from each other.

FIG. 9 illustrates a case in which the coil device includes two coils, but the number of coils may be determined according to need.

As set forth above, according to embodiments described above, a method of manufacturing a coil device and a coil device may reduce an amount of heat generated in the coil device, thereby enhancing charging efficiency, extending a lifespan of the device, and increasing a performance of a circuit.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A method of manufacturing a coil device, comprising:

forming a seed layer of a coil by bonding a conductive material to one surface of a base layer;

forming a seed layer of a coil by removing a portion of the conductive material to form a coil pattern through etching; and forming a plating layer of the coil on the seed layer of the coil through plating, wherein the forming the plating layer of the coil comprises, electrically connecting both ends of the seed layer of the coil to each other, applying a voltage through the both ends of the seed layer of the coil so that the seed layer has a predetermined electrical potential, and separating the both ends of the seed layer of the coil.

2. The method of claim 1, wherein the forming of the seed layer of the coil comprises:

coating a curable layer on the conductive material;

removing a portion of the curable layer through exposure and developing;

etching to remove a portion of the conductive material from which the curable layer is removed; and stripping the remaining curable layer.

3. The method of claim 2, wherein the removing of the portion of the curable layer through the exposure and the developing comprises:

changing a portion of the curable layer exposed to light into a photocured polymer and leaving a portion of the curable layer as an uncured monomer; and removing the uncured monomer portion of the curable layer, in response to immersing the conductive material in a developing solution.

4. The method of claim 2, wherein the curable layer is a dry film.

5. The method of claim 1, wherein the seed layer comprises only the conductive material, and the plating layer is formed only through the plating process.

6. The method of claim 1, wherein the base layer is formed of a material having relatively low conductivity and the seed layer is formed of a material having relatively high conductivity.

7. The method of claim 1, wherein the conductive material is bonded to the base layer through a hot press process.

8. The method of claim 1, wherein the conductive material is a copper foil.

9. The method of claim 1, wherein the coil comprises a first coil and a second coil, which form the seed layer such that a first end of a first seed layer of the first coil, a second end of the first seed layer of the first coil, a first end of a second seed layer of the second coil, and a second end of the second seed layer of the second coil are electrically connected to each other.

10. The method of claim 9, further comprising:

separating the first end of the first seed layer of the first coil, the second end of the first seed layer of the first coil, the first end of the second seed layer of the second coil, and the second end of the second seed layer of the second coil from each other.

* * * * *